United States Patent [19]

Getselev

[11] 4,126,175

[45] Nov. 21, 1978

[54] ELECTROMAGNETIC MOULD FOR THE CONTINUOUS AND SEMICONTINUOUS CASTING OF HOLLOW INGOTS

[76] Inventor: Zinovy N. Getselev, Prospekt Metallurgov, 73, kv.29., Kuibyshev, U.S.S.R.

[21] Appl. No.: 768,350

[22] Filed: Feb. 14, 1977

[51] Int. Cl.[2] ..... B22D 11/01

[52] U.S. Cl. ..... 164/147; 164/49; 164/421

[58] Field of Search ..... 164/147, 49, 85, 82, 164/273, 421

[56] References Cited

U.S. PATENT DOCUMENTS 3,741,280 6/1973 Kozheurov et al. ..... 164/49

3,886,996 6/1975 Tseitlin et al. ..... 164/85

FOREIGN PATENT DOCUMENTS 288,934 3/1971 U.S.S.R. ..... 164/85

*Primary Examiner*—Francis S. Husar
*Assistant Examiner*—John McQuade
*Attorney, Agent, or Firm*—Lackenbach, Lilling & Siegel

[57] ABSTRACT

An electromagnetic mould for the continuous and semi-continuous casting of hollow ingots and tubes includes two single-turn inductors connected in series, whose electro-magnetic fields form the external and internal surfaces of an ingot or a tube, the inductor forming the external surface of the ingot being 1,2 to 3 times higher than that forming the internal surface thereof.

7 Claims, 2 Drawing Figures

ELECTROMAGNETIC MOULD FOR THE CONTINUOUS AND SEMICONTINUOUS CASTING OF HOLLOW INGOTS

The present invention relates to metallurgy, and more particularly to electromagnetic moulds for continuous and semicontinuous casting.

The invention can be used for casting hollow ingots and tubes of ferrous and nonferrous metals and alloys thereof on conventional machines for continuous and semicontinuous casting.

Extensive use has been made of moulds for the continuous and semicontinuous casting of hollow blanks and tubes, which have a water-cooled cylindrical casing and a tapered casing mounted on the central part of the first casing, and disposed coaxially therewith. Both casings are filled with coolant and have holes through which the coolant is passed onto the external and internal surfaces of an ingot or a tube being cast.

In such a mould, however, the liquid metal directly contacts the internal surface of the cylindrical casing and the external surface of the tapered casing, which causes excessive roughness and segregation defects on the external and internal surfaces of the hollow ingots and tubes cast therein. That involves the subsequent machining of those products for further use thereof.

To improve the surface of the cast ingots, an electromagnetic mould for the continuous and semicontinuous casting thereof has been developed recently. This mould has an inductor whose electromagnetic field forms the surface of an ingot encircled thereby. The inductor is fixedly mounted in a cylindrical casing filled with coolant. The casing has ducts for the delivery of the coolant onto the surface of the ingot. A screen for distributing the inductor's electromagnetic field in an axial direction is placed between the internal surface of the inductor and the ingot surface. The screen has a suitable channel for coolant circulation.

Such a mould, however, cannot be used for casting hollow ingots and tubes.

It is therefore an object of the present invention to provide an electromagnetic mould for the continuous and semicontinuous casting of hollow ingots and tubes which ensures high quality thereof.

Another object of the invention is to provide for the casting of hollow ingots and tubes within a wide range of external and internal sizes thereof.

These objects are accomplished by the provision of an electromagnetic mould for the continuous and semicontinuous casting of ingots, comprising an inductor forming by its electromagnetic field an external surface of the ingot being cast, said inductor being fixedly mounted in a casing which is filled with coolant and has suitable holes for the delivery of said coolant onto the ingot external surface, and a screen for distributing the inductor's electromagnetic field in an axial direction, said screen being placed between the ingot external surface and the inductor's internal surface, wherein, according to the present invention, there is provided an additional inductor used to form by its electromagnetic field the internal surface of the hollow ingot, said additional inductor being disposed coaxially with the main inductor and being mounted in a respective additional casing filled with coolant and having holes for the delivery thereof onto the internal surface of the ingot, and an additional screen for distributing the electromagnetic field of said additional inductor in an axial direction, said additional screen being placed between the internal surface of the ingot and the external surface of said additional inductor.

It is expedient that the main and additional inductors in the electromagnetic mould for continuous and semicontinuous casting according to the invention should be connected in series, each of said inductors should have a single turn, and that the ratio between the height of the main inductor and that of the additional inductor should be selected from a range of 1.2 to 3.

The electromagnetic mould according to the invention makes it possible to obtain hollow ingots and tubes of proper shape with high-quality surfaces as a result of the following.

A single-turn feature of the main and additional inductors ensures the proper shape of the hollow ingots and tubes since it excludes the distortion of the current flow direction which arises at the connection points of inductor turns. Such a distortion results in a non-uniform distribution of the external electromagnetic field of an additional inductor along its external perimeter and that of the internal electromagnetic field of a main inductor along its internal perimeter, which causes the distortion of hollow-ingot shape.

The above-mentioned ratio (1.2 to 3) between the heights of the main and additional inductors makes for uniform electromagnetic-field intensities of said inductors connected in series, which is necessary for the following reasons.

The external surface of a hollow ingot is formed by an internal electromagnetic field of the main inductor, while the internal surface thereof is formed by an external electromagnetic field of the additional inductor. As is known, the external electromagnetic field of an inductor is always lower in intensity than the internal electromagnetic field thereof at a given intensity of the current supplied thereto. Thus, for instance, calculations and experimental tests have shown that the internal electromagnetic field intensity for the main inductor is about two times the external electromagnetic-field intensity for the additional inductor, with equal currents supplied to both inductors and the equal numbers of turns thereof. Hence, the electromagnetic pressure, whose value is proportional to the squared value of the electromagnetic-field intensity that acts upon the external surface of the hollow ingot being cast, is four times higher than the electromagnetic pressure acting upon its internal surface. That cannot be tolerated, for as the hydrostatic pressure of a liquid-metal column is equal on the external and internal surfaces thereof, the difference in said electromagnetic pressure values brings about the situation wherein the liquid metal on the internal surface of the hollow ingot is not held by the respective electromagnetic field. Therefore, the internal surface of the ingot fails to develop.

To increase the external electromagnetic-field intensity for the additional inductor and so provide for uniform conditions needed to form both external and internal surfaces of the ingot, the height of said additional inductor is reduced by a factor of 1.2 to 3 with respect to the height of the main inductor.

It is possible, by changing the height of the additional inductor, to change gradually and over a wide range the intensity of its external electromagnetic field in accordance with the internal electromagnetic field of the main inductor, and thereby to obtain hollow ingots of the required size. The aforesaid inductor heights ratio makes it possible to cast hollow ingots with the external and internal diameters being in the ratio of 1.1 to 10.

In addition, connection of the main and additional inductors in series simplifies construction of the electromagnetic mould.

Other objects and advantages of the present invention will become apparent as the description of its embodiments proceeds with reference to the accompanying drawings, wherein.

Figure 1:
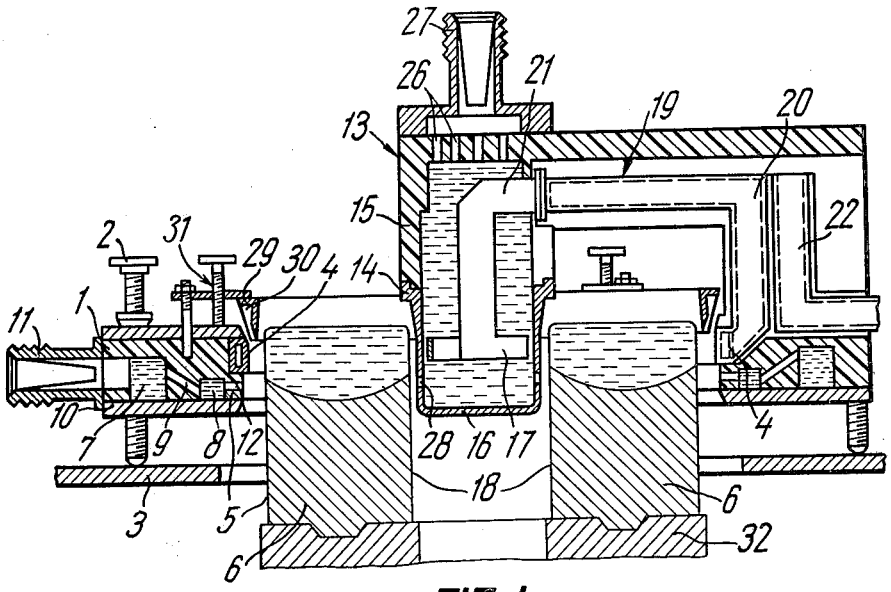
FIG. 1 shows a longitudinal section of an electromagnetic mould for the continuous and semicontinuous casting of ingots according to the invention.

The electromagnetic mould for the continuous and semicontinuous casting of ingots has a cylindrical casing 1 (FIG. 1) made of plastic and mounted with the aid of supporting members 2 on a plate 3. A single-turn inductor 4, made as an open ring of a hollow copper bar with rectangular cross-section, is placed in a circular recess on the internal wall of the casing 1. The inductor 4 is used to form by its electromagnetic field the internal surface 5 of an ingot 6, which surface 5 conforms to the shape of said inductor 4.

Circular slots 7 and 8 interconnected with throttle channels 9 are made in the wall of the casing 1. The slots 7 and 8 are closed by the bottom plate 10, forming in combination therewith annular channels for the coolant circulation. An inlet pipe 11 connected with the circular slot 7 is used for the delivery of coolant into the casing 1.

On the internal wall of the casing 1 along its perimeter there are provided holes 12 for the delivery of coolant, e.g. water, onto the external surface 5 of the hollow ingot 6.

A cylindrical casing 13 with a tapered middle portion 14 thereof is vertically mounted on the central part of the casing 1 so as to be concentric therewith. The top part 15 of the casing 13 is made of a dielectric material, e.g. plastic, whereas its bottom part 16 is made of a nonmagnetic material, e.g. stainless steel.

A single-turn inductor 17, made as an open ring of a solid copper bar with rectangular cross-section, is placed in the chamber of the bottom part 16 of the casing 13 so as to be concentric with the inductor 4. The inductor 17 is used to form by its external electromagnetic field the internal surface 18 of the ingot 6, which surface conforms to the shape of said inductor 17. The inductor 17 has a height 1.2 to 3 times smaller than that of the inductor 4. The inductors 4 and 17 are connected in series by means of a contact bar 19. A part 20 of the contact bar 19, connected to the inductor 4 and situated outside the casing 13, is of rectangular cross-section and hollow for the circulation of coolant, e.g. water, therethrough. A part 21 of the contact bar 19, connected to the inductor 17 and situated inside the casing 13, is a solid copper bar of rectangular cross-section.

Figure 2:
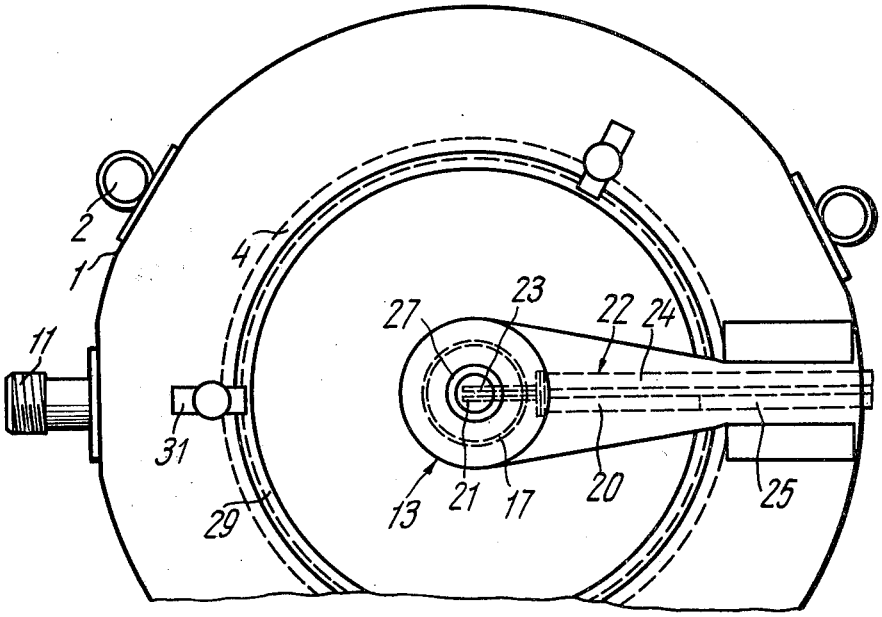
FIG. 2 is a plan view of the mould shown in FIG. 1 with parts of the mold being left out for the sake of clarity.

A current feed bar 22 is connected to the inductor 17. A part 23 (FIG. 2) of the bar 22, situated inside the casing 13, is a solid copper bar of rectangular cross-section. A part 24 of the bar 22, situated outside the casing 13, is a hollow copper bar of rectangular cross-section for the circulation of coolant, e.g. water, therethrough.

A current feed bar 25, connected to the inductor 4, is also a hollow copper bar of rectangular cross-section.

Holes 26 (FIG. 1) connected to an inlet pipe 27 for the delivery of coolant, e.g. water, into the casing 13, are provided in the top end-face wall of the latter. Holes 28 for the delivery of water and for the distribution thereof over the internal surface 18 of the ingot 6 are provided in the side walls of the bottom part of the casing 13.

To distribute internal electromagnetic field of the inductor 4 in an axial direction, there is provided a screen 29, which is placed between the external surface 5 of the ingot 6 and the internal surface of said inductor 4. The screen 29 is made of a non-magnetic material, e.g. stainless steel. It has a longitudinal section which ensures a lower intensity of the internal electromagnetic field of the inductor 4 in the screen's upper part. The screen 29 has a channel 30 for water circulation; it is fixedly mounted on the casing 1 by means of adjustable support members 31 which provide for its vertical displacement along the ingot 6.

The tapered portion 14 of the casing 13 serves as a screen for distributing an external electromagnetic field of the inductor 17 in an axial direction.

To effect the casting process, a baseplate 32 whose shape corresponds to that of the ingot 6 is placed on the work table of a casting machine (not shown).

The electromagnetic mould for the continuous and semicontinuous casting of ingots 6 operates as follows.

Prior to casting, the baseplate 32 is introduced into the space formed by the inductors 4 and 17. Said inductors 4 and 17, connected in series, are energized by electric current. Water is then delivered from the casings 1 and 13 through the respective holes 12 and 28 onto the external and internal surfaces of the baseplate 32, and liquid metal is delivered onto the top end face of said baseplate 32 while it is stationary.

The internal electromagnetic field of the inductor 4 and the external electromagnetic field of the inductor 17 induce eddy currents in the liquid metal. The interaction of the eddy currents with the corresponding electromagnetic fields of the inductors 4 and 17 produces electromagnetic forces which form the external surface 5 and the internal surface 18 of the ingot 6.

The ratio of 1.2 to 3 between the heights of the inductor 4 and the inductor 17, depending on ingot sizes provides for the uniform intensities of the corresponding electromagnetic fields that form the external surface 5 and the internal surface 18 of the ingot 6.

The use of the single-turn inductors 4 and 17 makes it possible to eliminate the distortion in a current flow direction which causes a non-uniform distribution of the external electromagnetic field of the inductor 17 along its external perimeter and the internal electromagnetic field of the inductor 4 along its internal perimeter. That makes for higher quality of the ingots 6 cast in the mould.

Once the liquid metal column formed by the electromagnetic fields 4 and 17 into the ingot 6 reaches the specified height, the baseplate 32 is moved downwards. The coolant, e.g. water, supplied from the casings 1 and 13 through the respective holes 12 and 28 onto the external surface 5 and the internal surface 18 of the ingot 6 ensures the solidification thereof.

I claim:

1. An electromagnetic mould for the continuous and semicontinuous casting of ingots, comprising: a first casing; a first inductor rigidly secured on said first casing for shaping with its electromagnetic field the external surface of an ingot; a first inlet pipe connected to said first casing for delivering coolant thereinto, said first casing being provided with holes for supplying coolant to the external surface of the ingot; a first screen for distributing the electromagnetic field of said first inductor in a substantially axial direction; a second casing mounted in the central part of said first casing; a second inductor mounted in said second casing in alignment with said first inductor for shaping with its electromagnetic field an internal surface of the ingot; a second inlet pipe connected to said second casing for delivering coolant thereinto, said second casing having holes therein for supplying coolant to the internal surface of the ingot; and a second screen for distributing the electromagnetic field of said second inductor in a substantially axial direction, said first and second inductors being connected in series and each having a single turn, the ratio between the height of said first inductor and the height of said second inductor being selected from the range of 1.2 to 3.

2. An electromagnetic mould as defined in claim 1, wherein said first casing is provided with channels for the coolant.

3. An electromagnetic mould as defined in claim 1, wherein said second casing is provided with channels for the coolant.

4. An electromagnetic mould as defined in claim 1, wherein said first screen is located inwardly of said first inductor and coaxially therewith.

5. An electromagnetic mould as defined in claim 1, wherein said second screen is located outwardly of said second inductor and coaxially therewith.

6. An electromagnetic mould as defined in claim 1, wherein said first screen is placed between the external surface of the ingot and the internal surface of said first inductor.

7. An electromagnetic mould as defined in claim 1, wherein said second screen is placed between the internal surface of the ingot and the external surface of said second inductor.

* * * * *